US006036305A

United States Patent [19]

Nagasaki et al.

[11] Patent Number: 6,036,305

[45] **Date of Patent: *Mar. 14, 2000**

[54] INK CARTRIDGE WITH RESIDUAL INK RETAINING STRUCTURE

[75] Inventors: Yoshiki Nagasaki; Shigeo Nonoyama; Shigeru Akema, all of Kawasaki; Takumi Kawamura, Inagi; Tomohisa Mikami, Kawasaki, all of Japan

[73] Assignee: Fujitsu, Limited, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/513,233

[22] Filed: Aug. 10, 1995

[30] Foreign Application Priority Data

Dec. 28, 1994 [JP] Japan ..... 6-328893

[51] Int. Cl.[7] ..... B41J 2/175; B41J 2/19

[52] U.S. Cl. ..... 347/86; 347/92; 347/93

[58] Field of Search ..... 347/86, 87, 7, 347/85, 92, 93; 251/149.6, 149.7, 333

[56] References Cited

U.S. PATENT DOCUMENTS

| | | | |
|---|---|---|---|
| 2,664,266 | 12/1953 | Johnson | 251/333 |
| 3,538,950 | 11/1970 | Porteners | 251/149.6 |
| 4,463,359 | 7/1984 | Ayata et al. | 347/56 |
| 4,524,724 | 6/1985 | Steudler, Jr. | 251/333 |
| 5,070,346 | 12/1991 | Mochizuki et al. | 347/7 |
| 5,162,817 | 11/1992 | Tajika et al. | 347/7 |
| 5,237,342 | 8/1993 | Saikawa et al. | 347/87 |
| 5,477,963 | 12/1995 | Mochizuki et al. | 347/86 |
| 5,523,780 | 6/1996 | Hirosawa et al. | 347/86 |
| 5,552,816 | 9/1996 | Oda et al. | 347/86 |
| 5,565,899 | 10/1996 | Sugimoto et al. | 347/93 X |
| 5,583,544 | 12/1996 | Stamer et al. | 347/7 |

FOREIGN PATENT DOCUMENTS

| | | | |
|---|---|---|---|
| 495 491 | 7/1992 | European Pat. Off. | B41J 2/165 |
| 1-098773 | 4/1989 | Japan | F16K 15/04 |
| 2-198861 | 8/1990 | Japan . | |
| 3-286876 | 12/1991 | Japan | 347/86 |
| 3-288652 | 12/1991 | Japan . | |
| 4-247961 | 9/1992 | Japan . | |
| 4-257452 | 9/1992 | Japan . | |
| 5-113163 | 5/1993 | Japan | F02M 61/18 |

*Primary Examiner*—David F. Yockey
*Attorney, Agent, or Firm*—Armstrong, Westerman, Hattori, McLeland and Naughton

[57] ABSTRACT

An ink cartridge connectable to a print head having a supply pipe which receives a supply of ink includes a casing having a first, upper chamber and a second, lower chamber communicating with each other via a communicating hole and storing the ink, a porous body provided in the first chamber and storing the ink by a negative pressure, and a connection part provided in the second chamber and connectable to the supply pipe. The connection part has normally closed valve means for communicating the print head with the second chamber by opening when the supply pipe is inserted into the connection part. The ink cartridge includes a connecting pipe extending from the first chamber into the second chamber and a filter member covering the opening of the connecting pipe in the second chamber. The filter member releases air from the connecting pipe upwardly into an upper region of the second chamber.

8 Claims, 9 Drawing Sheets

INK CARTRIDGE WITH RESIDUAL INK RETAINING STRUCTURE

BACKGROUND OF THE INVENTION

1. Field of the Invention

The present invention relates to ink cartridges, print heads and ink-jet printers, and more particularly to an ink cartridge attachable to and detachable from a print head of an ink-jet printer, and to a print head and an ink-jet printer using such an ink cartridge.

2. Description of the Prior Art

When the ink runs out, an ink-jet printer becomes instantly incapable of printing; that is, so-called missing dots occur. Accordingly, it is necessary to detect a residual quantity of the ink, to halt the printing operation of the ink-jet printer before the missing dots occur, and to generate an alarm urging a user to supplement the ink. One approach to detect the residual quantity of the ink is a method whereby a pair of electrodes are provided inside an ink tank which stores the ink, and a variation in the value of resistance is monitored by applying a pulse voltage while ensuring that no electrolysis takes place between the electrodes.

Supplement of the ink is a laborious operation. From the viewpoint of the running cost of the ink-jet printer, it is preferable that an ink cartridge which stores the ink be exchanged when the alarm is generated. Various constructions of the ink cartridge are proposed.

FIG. 1 shows an example of conventional ink cartridge in a lateral sectional view and a print head in a side view. Referring to FIG. 1, a print head 501 has an ink needle 503. An ink cartridge 502 has an elastic member 504, an ink 505 and a sponge 506 for creating a negative pressure with respect to the ink 505. The ink cartridge 502 is fitted to the print head 501 such that the elastic member 504 is pierced by the ink needle 503 of the print head 501. In an action reverse to the piercing action, the cartridge 502 is detached from the print head 501.

In normal use, the ink cartridge 502 is detached only when the ink has run out and the ink cartridge 502 is exchanged for a new one. However, the user may need to exchange the ink cartridge 502 in order to use an ink having a different color. Or the user may wrongly recognize that the ink has run out, that is, the ink is depleted, and detach the ink cartridge 502. Or the user may detach the ink cartridge 502 in order to perform a maintenance activity including a cleaning of the print head 501 of the ink-jet printer.

When the ink cartridge 502 is detached from the print head 501 in a state where the ink in the ink cartridge 502 has not run out, the detached ink cartridge 502 is attached again to the print head 501 for continued use. Detaching of the ink cartridge 502 from the print head 501 and re-attaching the same to the print head 501 means that a passage of the ink between the print head 501 and the ink cartridge 502 is cut for a time and then re-established. For this reason, it is inevitable that air bubbles intrude into the print head 501 and the ink cartridge 502 through the passage of the ink, when the ink needle 503 pierces the elastic member 504 again. If left uncontrolled, the air bubbles that intrude into the ink cartridge 502 intrude into the print head 501 sooner or later.

When the air bubbles intrude into the print head 501, missing dots occur at some point of time. Conventionally, a mechanism called a backup unit for protecting the print head 501 is provided. In order to prevent the missing dots, the backup unit is used to remove the air bubbles from a nozzle of the print head 501 by suction. Some ink may also be removed together with the air bubbles unnecessarily when the air bubbles are removed from the nozzle. Hence, there is a problem in that activating the backup unit every time the ink cartridge 502 is attached does not have much advantage because it causes the ink to be wasted.

Further, the air bubbles that intrude into the ink cartridge 502 may come into contact with the electrodes for detecting the residual quantity of the ink, thus causing the value of resistance to vary. Consequently, there is a problem that, despite the fact that a new ink cartridge is attached to the print head 501, the ink is wrongly detected as having run out.

Besides, it is desired that some measure be taken to prevent a leakage of the ink from occurring when the ink cartridge 502 is removed from the print head 501.

SUMMARY OF THE INVENTION

Accordingly, an object of the present invention is to provide a novel and useful ink cartridge, print head and ink-jet printer in which the aforementioned problems are eliminated.

Another and more specific object of the present invention is to provide an ink cartridge, a print head and an ink-jet printer in which a measure is taken to ensure that air bubbles do not intrude into the ink cartridge or the print head when the ink cartridge is attached to or detached from the print head, so that the printing is done in a reliable manner, and in which the ink is dependably prevented from leaking when the ink cartridge is detached from the print head.

The aforementioned objects can be achieved by an ink cartridge connectable to a print head having a supply pipe which receives a supply of ink, the ink cartridge comprising: a casing having first and second chambers communicating with each other via a communicating hole and storing the ink; a porous body provided in the first chamber and storing the ink by a negative pressure; and a connection part provided in the second chamber and connectable to the supply pipe, the connection part having normally closed valve means for communicating the print head with the second chamber by opening when the supply pipe is inserted into the connection part. According to the ink cartridge of the present invention, air bubbles are dependably prevented from intruding into the ink cartridge or the print head when the ink cartridge is attached to or detached from the print head, and the ink is dependably prevented from leaking when the ink cartridge is detached from the print head. In this way, it is possible to improve the reliability of the ink-jet printer.

In a preferred embodiment, a portion of the valve means making contact with the supply pipe has a shape which prevents a gap from being created when the supply pipe makes contact with the valve means. According to this aspect of the present invention, air bubbles are dependably prevented from intruding into the ink cartridge or the print head when the ink cartridge is attached to the print head.

In another preferred embodiment, the valve means comprises: a valve having a hemispherical surface that is convex in a predetermined direction in which the ink cartridge approaches the print head when connecting the ink cartridge to the print head; a packing having a hemispherical surface that is concave in a direction opposite to the predetermined direction;

and a spring urging the valve against the packing in the predetermined direction. According to this aspect of the present invention, air bubbles are dependably prevented from intruding into the ink cartridge or the print head when the ink cartridge is attached to the print head, using a simple construction.

In another preferred embodiment, the valve means comprises: a valve having a hemispherical surface that is convex in a predetermined direction in which the ink cartridge approaches the print head when connecting the ink cartridge to the print head; an O ring; and a spring urging the valve against the O ring in the predetermined direction. According to this aspect of the present invention, air bubbles are dependably prevented from intruding into the ink cartridge or the print head when the ink cartridge is attached to the print head.

In still another preferred embodiment, the valve and the packing are made of a resilient material having a hardness of 40 degrees to 70 degrees. According to this aspect of the present invention, a gap is prevented from being created when the supply pipe comes into contact with the valve means.

In still another preferred embodiment, the valve and the O ring are made of a resilient material having a hardness of 40 degrees to 70 degrees. According to this aspect of the present invention, a gap is prevented from being created when the supply pipe comes into contact with the valve means.

In another preferred embodiment, the ink cartridge further comprises a plurality of electrodes provided in the second chamber so as to detect a residual quantity of the ink. According to this aspect of the present invention, it is possible to detect a residual quantity of the ink accurately and reliably.

In another preferred embodiment, the ink cartridge further comprises: a passage having a first end communicating with the first chamber and a second end communicating with the second chamber; and a filter member provided at the second end of the passage, the filter member compensating by a meniscus force thereof a decrease in an ink retaining capability of the porous body that is dependent on a negative pressure which decreases as a residual quantity of the ink in the casing decreases. According to this aspect of the present invention, the ink can be retained by a negative pressure even when the residual quantity of the ink decreases.

In another preferred embodiment, the first end of the passage opens to and communicates with the first chamber in a first predetermined direction opposite to a second predetermined direction in which the ink cartridge approaches the print head when connecting the ink cartridge to the print head, and the second end of the passage opens to and communicates with the second chamber in the second predetermined direction. According to this aspect of the present invention, the ink can be retained by a negative pressure using a simple construction even when the residual quantity of the ink decreases.

In still another preferred embodiment, the filter member is made of a mesh material having a fineness value of 30 to 800. According to this aspect of the present invention, the ink can be retained by a negative pressure using a simple construction even when the residual quantity of the ink decreases.

In another preferred embodiment, the filter member is made of a material providing a contact angle greater than 5 degrees with respect to the ink. According to this aspect of the present invention, the ink can be retained by a negative pressure using a simple construction even when the residual quantity of the ink decreases.

In yet another preferred embodiment, the ink cartridge further comprises a plurality of electrodes provided in the second chamber so as to detect a residual quantity of the ink. According to this aspect of the present invention, it is possible to detect the residual quantity of the ink accurately and reliably. Also, a variation in the actual quantity of the ink that remain in the ink, with each detection of the depletion of the ink, is eliminated.

In another preferred embodiment, the plurality of electrodes are disposed at predetermined positions in the second chamber such that, when the ink is detected as having run out, a quantity of the ink that actually remains in the second chamber is sufficient to print on at least one page. According to this aspect of the present invention, it is possible to print on at least one page after the ink is detected as having run out so that there is no fear of the ink running out abruptly during a printing operation.

The aforementioned objects can also be achieved by a print head connectable to an ink cartridge which includes a casing having a chamber that stores ink, and a normally closed connection part which is provided in the chamber, the print head comprising: a supply pipe inserted into the connection part of the ink cartridge so as to receive a supply of the ink; a nozzle; and an injection energy generating element injecting, via the nozzle, the ink supplied from the supply pipe, wherein the supply pipe comprises: an end part having a shape which prevents a gap from being created when the supply pipe makes contact with the connection part; and one or a plurality of holes provided at the end and part opening to the chamber when the supply pipe is inserted into the connection part. According to the print head of the present invention, air bubbles are prevented from intruding into the ink cartridge or the print head when the ink cartridge is attached to the print head, using a simple construction. Thereby, missing dots are prevented from occurring, and the ink is dependably prevented from leaking outside the ink cartridge when the ink cartridge is detached from the print head. In this way, it is possible to improve the reliability of the ink-jet printer.

The aforementioned objects of the present invention can also be achieved by an ink-jet printer which uses an ink cartridge which includes a casing mountable to and detachable from a print head and having a chamber that stores ink, and a normally closed connection part which is provided in the chamber, the ink-jet printer comprising: a carrier; and a print head part connectable to the carrier and driven together with the carrier, the print head part comprising one or a plurality of print heads, the print head comprising: a supply pipe inserted into the connection part of the ink cartridge and receiving a supply of the ink; a nozzle; and an injection energy generating element injecting, via the nozzle, the ink supplied from the supply pipe, and the supply pipe comprising: an end part having a shape which prevents a gap from being created when the supply pipe makes contact with the connection part; and one or a plurality of holes provided at the end part and opening to the chamber when the supply pipe is inserted into the connection part. According to the ink-jet printer of the present invention, air bubbles are prevented from intruding into the ink cartridge or the print head when the ink cartridge is attached to the print head, using a simple construction. Thereby, missing dots are prevented from occurring, and the ink is dependably prevented from leaking outside the ink cartridge when the ink cartridge is detached from the print head. In this way, it is possible to improve the reliability of the ink-jet printer.

BRIEF DESCRIPTION OF THE DRAWINGS

Other objects and further feature of the present invention will be apparent from the following detailed description when read in conjunction with the accompanying drawings, in which.

DESCRIPTION OF THE PREFERRED EMBODIMENTS

Figure 1:
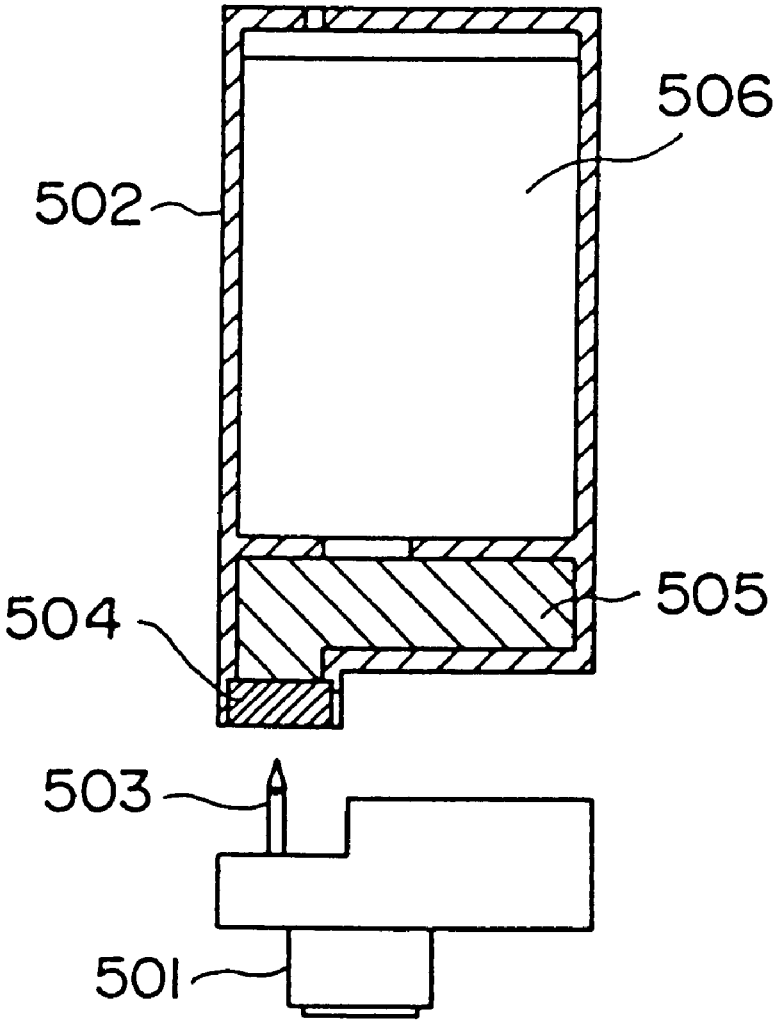
FIG. 1 PRIOR ART
FIG. 1 shows an example of a conventional ink cartridge in a lateral sectional view and a print head in a side view.
Figure 2:
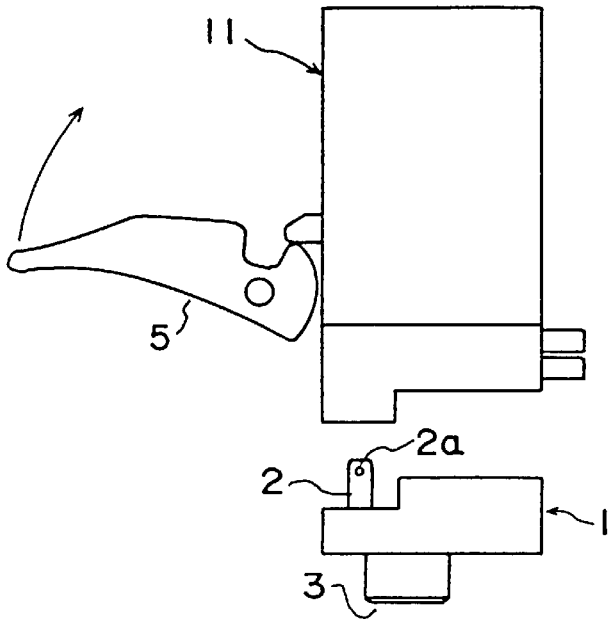
FIG. 2 is a side view of a first embodiment of the ink cartridge and a first embodiment of the print head.

FIG. 2 is a side view of a first embodiment of the ink cartridge and a first embodiment of the print head according to the present invention.

Referring to FIG. 2, a print head 1 has a supply pipe 2 for supplying the ink and a nozzle 3. An ink cartridge 11 is attachable to and detachable from the print head 1 by operating an attachment/detachment lever 5. It is of course possible to provide a guiding mechanism (not shown) for guiding the ink cartridge 11 when the ink cartridge 11 is attached to or detached from the print head 1.

Figure 3:
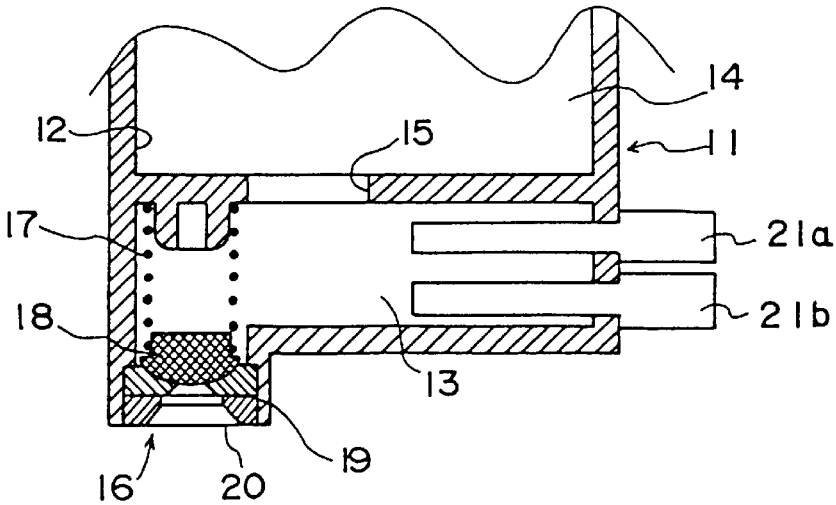
FIG. 3 is a lateral sectional view showing a feature of the first embodiment of the ink cartridge.

FIG. 3 is a lateral sectional view showing a feature of the ink cartridge 11. Referring to FIG. 3, a chamber 12 is provided in an upper portion of a casing of the ink cartridge 11, and a chamber 13 is provided in a lower portion of the casing. A sponge 14 for retaining the ink inside the ink cartridge 11 is accommodated in the chamber 12. Of course, any appropriate porous body may be used instead of the sponge 14. The chamber 13 temporarily retains the ink supplied to the print head 1. The chambers 12 and 13 communicate with each other via a communicating hole 15.

In this example, a connection part 16 which connects to the supply pipe 2 of the print head 1 is provided in the left of the chamber 13. However, the position of the connection part 16 is not limited to this position. The connection part 16 is provided with a coil spring 17, a valve 18, a packing 19 and a plate member 20. Under normal conditions, the valve 18 of the chamber 13 having a hemispherical surface which is convex is in close contact with the packing 19 having a hemispherical surface which is concave due to a spring force of the coil spring 17. Thus, the chamber 13 is sealed to the outside of the ink cartridge 11. Therefore, in this state, there is no likelihood that the ink is leaked outside the ink cartridge 11 via the connection part 16. The plate member 20 is used to fix the packing 19 to the connection part 16.

A pair of electrodes 21*a* and 21*b* are provided in the right of the chamber 13. One end of each of the electrodes 21*a* and 21*b* is introduced into the chamber 13, and the other end of each of the electrodes 21*a* and 21*b* projects outside the ink cartridge 11. An impulse voltage is applied to the electrodes 21*a* and 21*b*. The residual quantity of the ink inside the chamber 13 is known by detecting a potential difference between the electrodes 21*a* and 21*b* using a known method.

If the electrodes 21*a* and 21*b* are provided in the chamber 12, it is difficult to detect the residual quantity of the ink accurately because the ink retained by the sponge 14 is not uniformly consumed. Specifically, if the electrodes 21*a* and 21*b* are provided in the chamber 12, and if a large quantity of ink is retained by a limited portion of the sponge 14, there is produced a variation in the actual quantity of the ink that remain in the ink, with each detection of the depletion of the ink. In the worst case, despite the fact that the ink is detected as remaining in sufficient quantity, the ink runs out abruptly while a printing is performed, causing an improper printing.

In this embodiment, the electrodes 21*a* and 21*b* are not provided in the chamber 12 but in the chamber 13. This means that the detection of the residual quantity of the ink is performed in the ink, that is, in the liquid in which a porous body like a sponge is not provided. Thus, it is possible to detect the residual quantity of the ink accurately. Accordingly, disadvantages including an erroneous detection of the depletion of the ink, or a failure to detect depletion of the ink are prevented. It is always possible to detect the residual quantity of the ink accurately.

Figure 4:
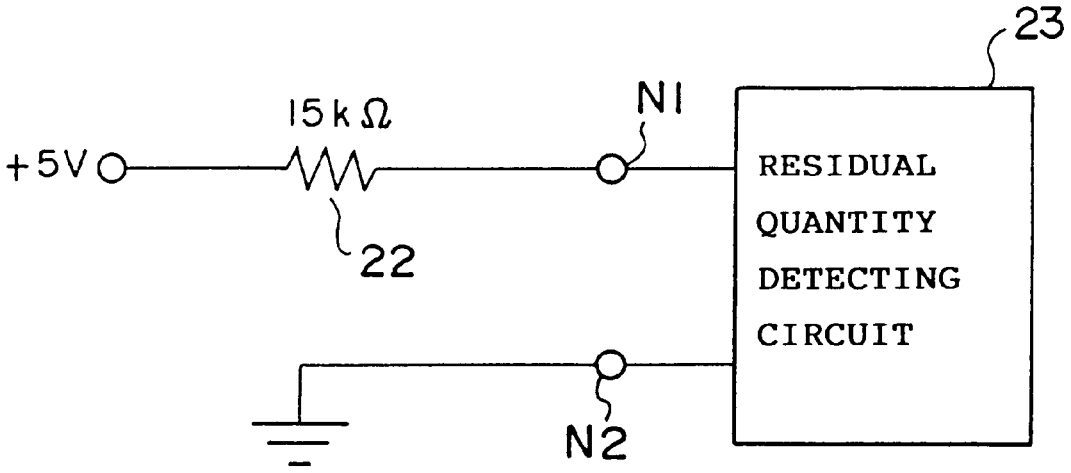
FIG. 4 is a circuit diagram showing an example of circuit for detecting a residual quantity of an ink in a chamber.

FIG. 4 is a circuit diagram showing an example of a circuit for detecting the residual quantity of the ink inside the chamber 13. Referring to FIG. 4, an end of a node N1 is connected to a power supply voltage +5V via a resistor 22 and its other end is connected to the electrode 21*a* and a residual quantity detecting circuit 23. An end of a node N2 is grounded, and its other end if connected to electrode 21*b* and the residual quantity detecting circuit 23. The value of resistance between the electrodes 21*a* and 21*b* varies with the residual quantity of the ink inside the chamber 13. Hence, the residual quantity detecting circuit 23 is capable of detecting the residual quantity of the ink inside the chamber 13 by detecting the potential difference between the node N1 and the node N2. Since the residual quantity detecting circuit 23 described above belongs to a known art, illustration and description of its internal construction is omitted.

Figure 5:
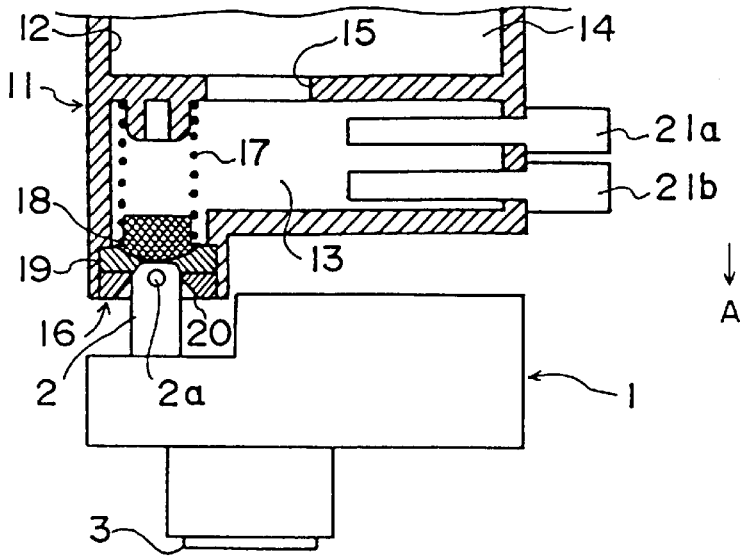
FIG. 5 shows a state where an end of a supply pipe of the print head comes into contact with a connection part of the ink cartridge.
Figure 6:
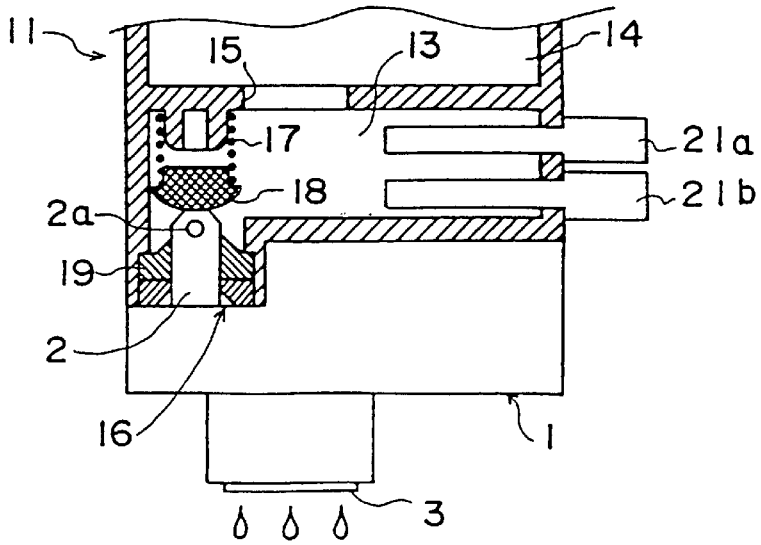
FIG. 6 shows a state where the ink cartridge is properly attached to the print head.

A description will now be given, with reference to FIGS. 5 and 6, of how the ink cartridge 11 is attached to the print head 1. FIG. 5 shows a state where an end of the supply pipe 2 of the print head 1 comes into contact with the connection part 16 of the ink cartridge 11, showing the ink cartridge 11 in a sectional view. FIG. 6 shows a state where the ink cartridge 11 is properly attached to the print head 1, showing the ink cartridge 11 in a sectional view.

In the state shown in FIG. 5, the valve 18 is pressed to deform by the end of the supply pipe 2, resulting in no gap being created between the valve 18 and the end of the supply pipe 2. Since the packing 19 has a shape that corresponds to the shape of the end of the supply pipe 2, the air does not remain in the neighborhood of the valve 18 and the supply pipe 2 and air bubbles do not intrude into the chamber 13 of the ink cartridge 11. In this embodiment, the tapering outline of the end of the supply pipe 2 corresponds to the tapering outline of the opening at the bottom of the packing 19. The bottom of the valve 18 has a hemispherical convex shape and the top of the packing 19 has a hemispherical concave shape.

The shapes of the end of the supply pipe 2, the valve 18 and the packing 19 are not limited to the shapes shown in FIG. 5. Moreover, the material that forms the valve 18 and the packing 19 is not limited to a resilient material as used in this embodiment. Any material capable of preventing air bubbles from intruding into the chamber 13 may be employed. The important thing is that the material forming the valve 18 and the packing 19 is of such a shape and nature that does not allow the air to remain in the neighborhood of the valve 18 and the supply pipe 2 in a state where the supply pipe 2 is in contact with the connection part 16 of the ink cartridge 11.

In this embodiment, it is preferred that the valve 18 and the packing 19 are made of a ethylene propylene rubber having a 40°–70° hardness.

Referring to FIG. 5, the ink cartridge 11 is thrust further in a direction indicated by the arrow A toward the print head 1, resulting in a state shown in FIG. 6. In the state shown in FIG. 6, the valve 18 is elevated by the supply pipe 2 against the force of the coil spring 17. A hole 2*a* provided at the end of the supply pipe 2 opens to the chamber 13. Accordingly, the ink in the chamber 13 is supplied to the print head 1 via the hole 2*a*. One or a plurality of holes 2*a* may be provided at the end of the supply pipe 2. The size and shape of the hole 2*a* are not limited to the size and shape assumed in this embodiment. The important thing is that the ink in the chamber 3 is properly supplied to the print head 1 via the hole 2*a* of the supply pipe 2 in a state where the ink cartridge 11 is perfectly attached to the print head 1 as shown in FIG. 6. The size, shape and position of the hole 2*a* may be set appropriately depending on the type of the ink used.

The ink cartridge 11 can be detached from the print head 1 by performing an action reverse to the action described above. In a normal state where the ink cartridge 11 is detached from print head 1, the valve 18 is in contiguous contact with the packing 19 by the spring force of the coil spring 17. Thus, the chamber 13 is sealed with respect to the outside of the ink cartridge 11. Accordingly, there is no likelihood that the ink leaks outside the ink cartridge 11 via the connection part 16.

Figure 7:
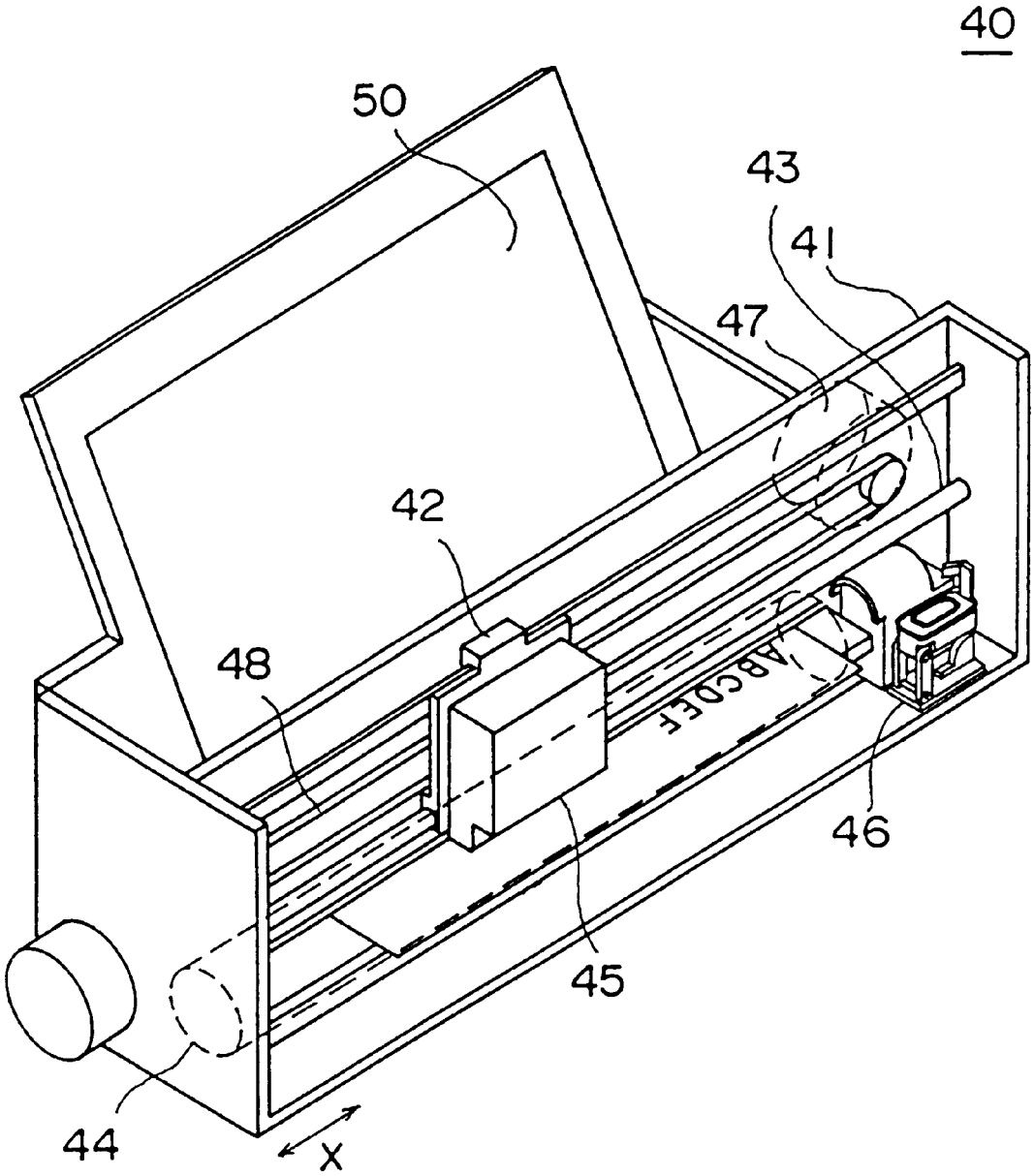
FIG. 7 is a perspective view showing a feature of a first embodiment of the ink-jet printer.
Figure 8:
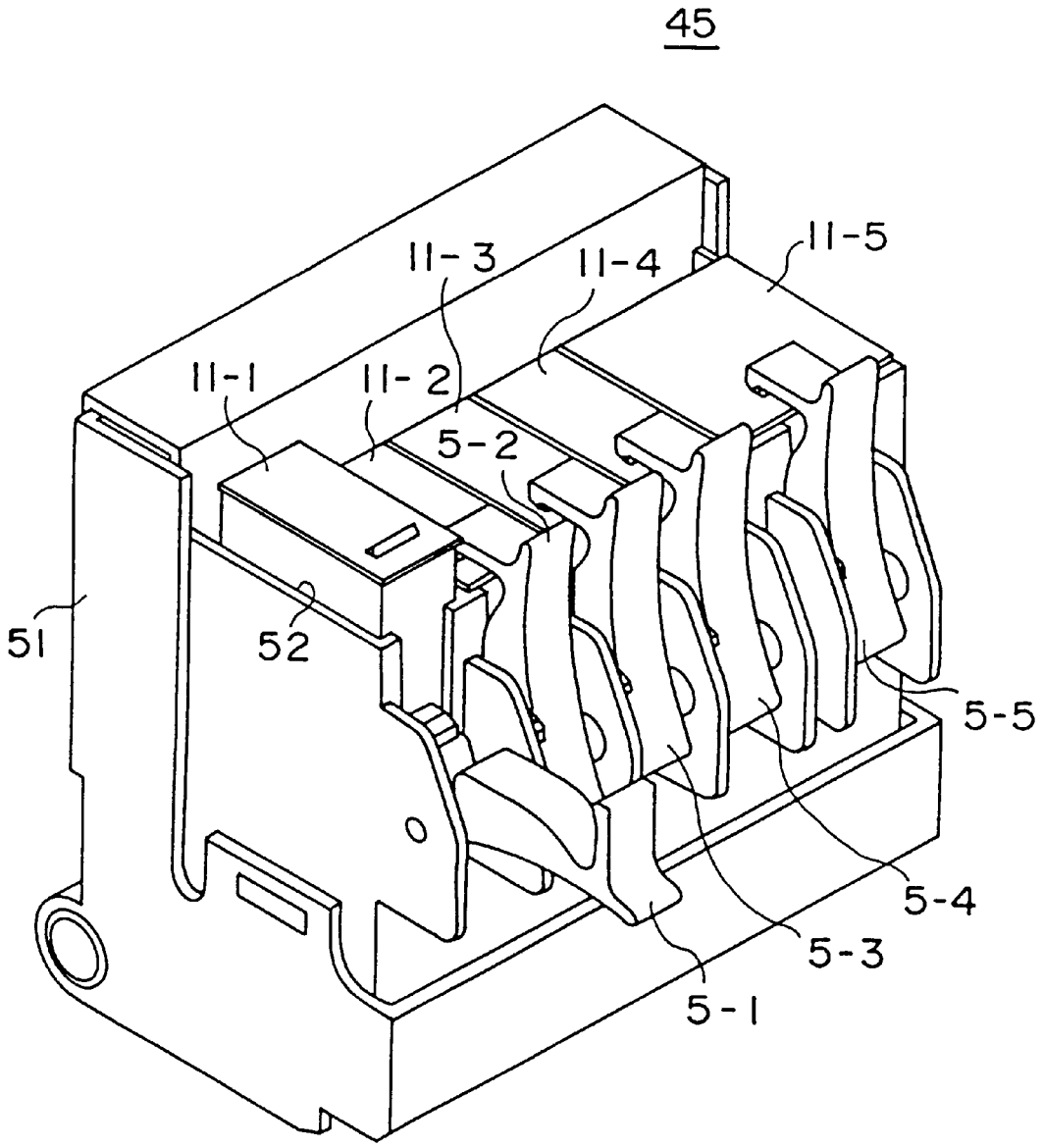
FIG. 8 is a perspective view showing a print head part.

A description will now be given, with reference to FIGS. 7 and 8, of a first embodiment of the ink-jet printer according to the present invention. FIG. 7 is a perspective view showing a feature of the first embodiment of the ink-jet printer, and FIG. 8 is a perspective view showing a print head part. In the first embodiment of the ink-jet printer, the first embodiment of the ink cartridge and the second embodiment of the print head are used.

Referring to FIG. 7, an ink-jet printer 40 generally comprises a frame 41, a carrier 42, a stage shaft 43, a paper feed roller 44, a print head part 45, a backup unit 46, a motor 47 and a belt 48. The carrier 42 is driven by the motor 47 via the belt 48 and movable in a direction indicated by the arrow X in FIG. 7 guided by the stage shaft 43. The print head part 45 is fitted to the carrier 42. Paper 50 is fed by the paper feed roller 44. The print head part 45 prints an image on the paper 50 in accordance with image data received from a host apparatus (not shown).

The backup unit 46 is provided as a mechanism for protecting the print head part 45. When the print head part 45 is located at a stand-by position at the right end of its translation in FIG. 7, the backup unit 46 removes the ink and the air bubbles from the nozzle of the print head part 45 by suction in response to a predetermined operation by the user. Thereby, the missing dots are prevented from occurring.

Known constructions can be used in those parts of the ink-jet printer 40 including the frame 41, the carrier 42, the stage shaft 43, the paper feed roller 44, the backup unit 46, the motor 47 and the belt 48. Therefore, detailed descriptions of the construction and function of these parts are omitted.

The feature of this embodiment is the construction of the print head part 45. A description will be given, with reference to FIG. 8, of the construction of the print head part 45. FIG. 8 shows the print head part 45, a cover being removed.

Referring to FIG. 8, the print head part 45 has a housing 51. The housing 51 has attachment/detachment levers 5-1–5-5. Slots 52 are provided in the housing 51 in locations that correspond to the attachment/detachment levers 5-1–5-5. Ink cartridges 11-1–11-5 are respectively inserted into the slots 52, each of the ink cartridges 11-1–11-5 being attachable to and detachable from the corresponding print head (not shown) by operating the corresponding one of the attachment/detachment levers 5-1–5-5. FIG. 8 shows only the ink-cartridge 11-1 being in an interim state before its complete insertion into the slot 52 or before its complete removal from the slot 52, depending on how you look at it in FIG. 8. In this embodiment, five print heads are provided with respect to the five ink cartridges 11-1–11-5 at the bottom of the housing. However, the print heads are not shown in FIG. 8. The ink cartridges 11-1–11-5 and the print heads have the same construction as the construction shown in FIGS. 2, 3, 5 and 6. Thus, the second embodiment of the print head includes a plurality of the print heads (first embodiment).

The presence of a plurality of print heads may only be an appearance provided by a plurality of supply pipes, from the point of view that the print head part 45 is formed as an integral unit in which separate passages for the inks of different colors are formed. Basically, the print head part comprises a nozzle part for monochrome printing and a nozzle part for color printing are provided.

In this embodiment, the ink cartridges 11-1–11-4 store black ink, yellow ink, magenta ink and cyan ink, respectively. These inks are used for color printing. The ink cartridge 11-5 is larger than the ink cartridges 11-1–11-4 and store black ink used for monochrome printing. Thus, different black inks from different ink cartridges are used in color printing and in monochrome printing. With this construction, it is possible to use different print head structures for the print head corresponding to the ink cartridges 11-1–11-4 and for the print head corresponding to the ink cartridge 11-5.

Specifically, in color printing wherein different colors are used, mixture of color occurs on paper if the ink is dried slowly. In this case, a soaking ink having a relatively large quantity of solvent is used for a specified type of paper. In monochrome printing, ordinary paper such as PPC is used. In order to effect a quality printing on such paper, an evaporable ink including a relatively large quantity of water and an added alcohol content is used so as to prevent blurring from occurring.

Of course, at least one ink cartridge and at least one print head corresponding thereto may be provided.

Figure 9:
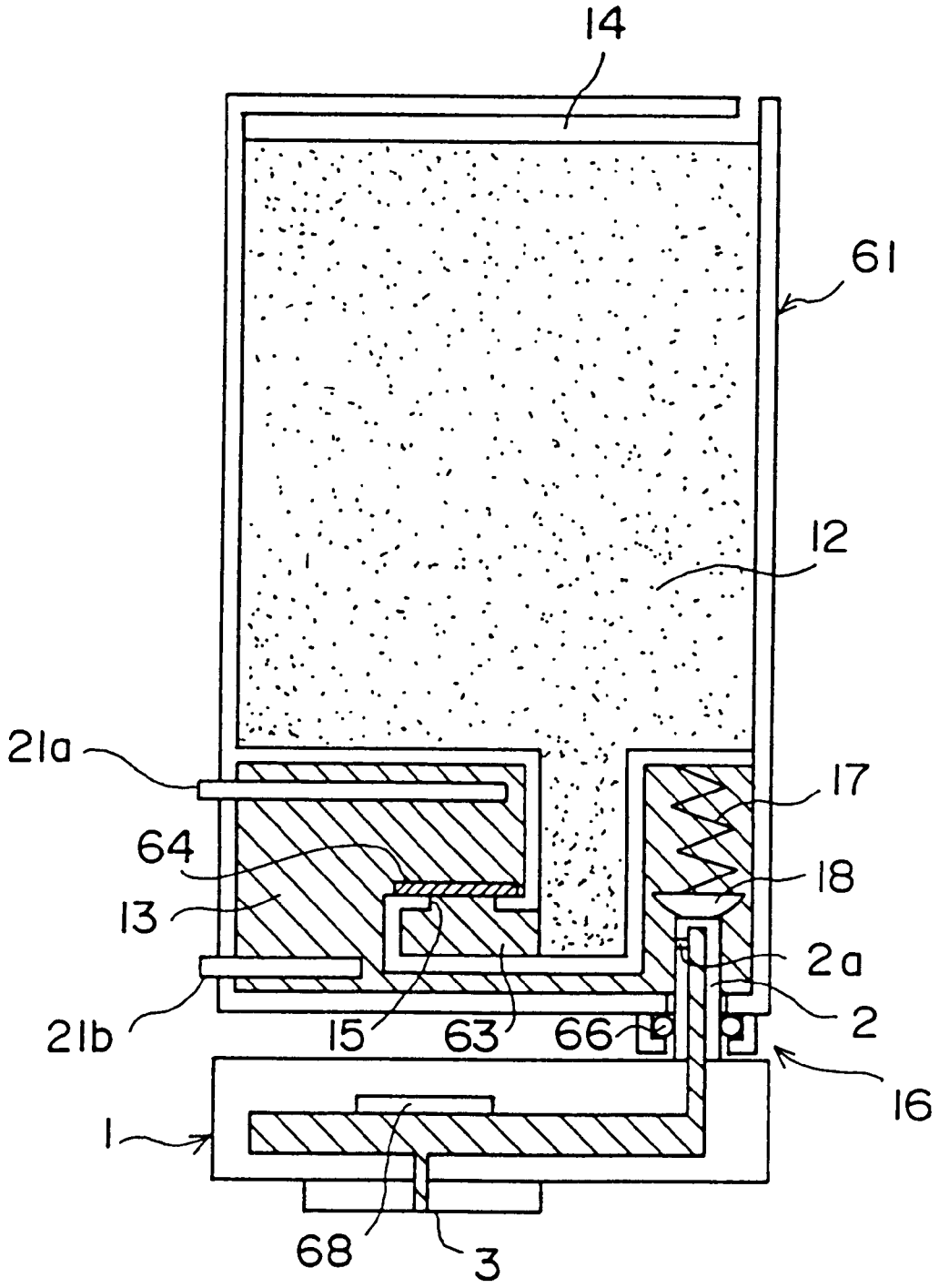
FIG. 9 is a lateral sectional view showing a second embodiment of the ink cartridge and a third embodiment of the print head.
Figure 10:
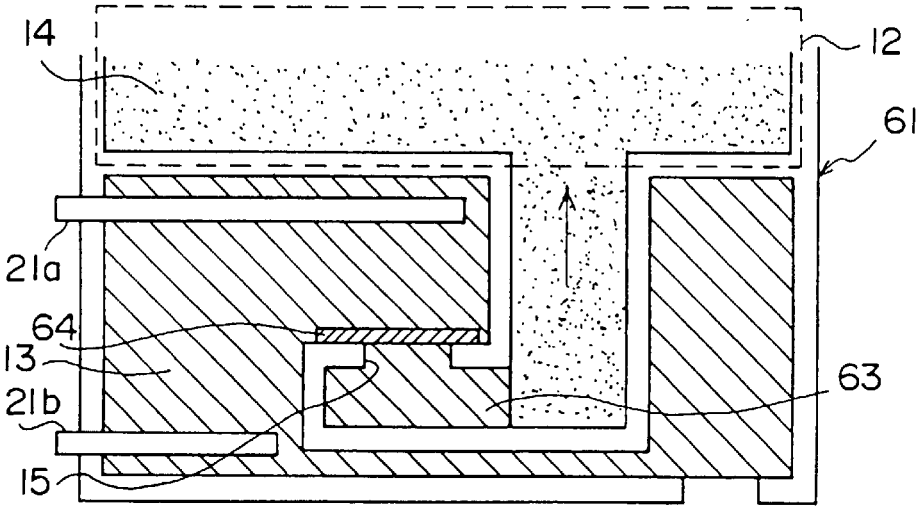
FIG. 10 is a lateral sectional view which explain the operation of the second embodiment of the ink cartridge and the third embodiment of the print head.
Figure 11:
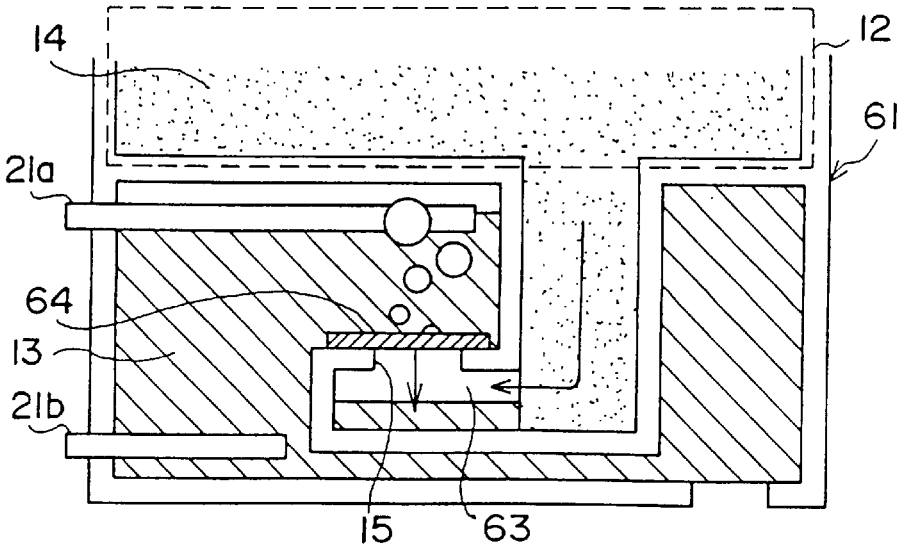
FIG. 11 is a lateral sectional view which explain the operation of the second embodiment of the ink cartridge and the third embodiment of the print head.

A description will now be given, with reference to FIGS. 9 through 11, of a second embodiment of the ink cartridge according to the present invention. FIG. 9 is a lateral sectional view showing the second embodiment of the ink cartridge and a third embodiment of the print head according to the present invention. FIGS. 10 and 11 lateral sectional views showing the operation of the second embodiment of the ink cartridge and the third embodiment of the print head, the connection part 16 and the top of an ink cartridge 61 being omitted from illustration. In FIGS. 9 through 11, those components that are the same as the components of FIGS. 2, 3, 5 and 6 are designated by the same reference numerals and the description thereof is omitted.

In this embodiment, as shown in FIG. 9, a portion of the chamber 12 of the ink cartridge 61 protrudes into the chamber 13. The chamber 12 and the chamber 13 communicate with each other via a passage 63 communicating with a communicating hole 15. The passage 63 is constructed so as not to block the flow of the ink. An end of the passage 63 opens upward to the chamber 12, and the other end thereof opens upward to the chamber 13 via the communicating hole 15. The communicating hole 15 is provided with a filter member 64.

The filter member 64 is made of a #30 to #800 mesh water repellent stainless steel or the like. The volume of the chamber 13 is set such that the volume of the ink retained within the chamber 13 by a meniscus force of the filter member 64 after air bubbles come into contact with the electrodes 21*a* and 21*b* is approximately 0.05 cc.

As indicated by the arrow in FIG. 10, the ink is held inside the chamber 12 of the ink cartridge 61 by a negative pressure produced by the sponge 14. However, as the amount of the ink that remains in the sponge 14 decreases in proportion to the ink consumption, air bubbles intrude into the passage 63 and the sponge 14, as indicated by the bent arrow in FIG. 11, thereby canceling the negative pressure provided by the sponge 14. Consequently, the retaining of the ink by the sponge 14 becomes impossible.

The moment the negative pressure provided by the sponge 14 is canceled, a meniscus force as indicated by the straight arrow in FIG. 11 is formed by the filter member 64. Thanks to the negative pressure produced by this meniscus force, the ink within the chamber 13 is retained.

As the ink is further consumed, the meniscus force provided by the filter member 64 is also canceled, with the result that air bubbles intrude into the chamber 13. However, immediately after air bubbles leave the filter member 64, the meniscus force is produced again. Hence, it is possible to continually retain the ink with a negative pressure until the ink surface becomes lower than the filter member 64.

When the residual quantity of the ink decreases to a significant degree, air bubbles come to stay high enough in the chamber 13 to come into contact with the electrodes 21*a* and 21*b*. Consequently, the value of resistance between the electrodes 21*a* and 21*b* is altered. Accordingly, the amount of the ink that remain is accurately known by detecting this variation in the resistance value using a residual quantity detecting circuit as shown in FIG. 4.

In a normal state where the ink cartridge 61 is not attached to the print heat 1, the valve 18 shown in FIG. 9 is thrust against an O ring 66 by the coil spring 17 so as to prevent the ink from leaking outside the ink cartridge 61. When the ink cartridge 61 is attached to the print head 1, the supply pipe 2 of the print head 1 elevates the valve 18 against the spring force of the coil spring 17. An ink passage is formed between the chamber 13 and the print head 1 via the hole 2*a* of the supply pipe 2. The ink supplied by the ink cartridge 61 is pressurized by an injection energy generating element 68 of the print head 1 so that the ink is turned into ink droplets and is injected from the nozzle 3 to recording medium such as paper (not shown). The O ring 66 is formed, for example, of a same material as the valve 18. The injection energy generating element 68 is formed, for example, of a piezoelectric element.

As has been described, when the negative pressure provided by the sponge 14 in the chamber 12 is canceled, causing the air intruding into the chamber 13, a meniscus force is created by the filter member 64. A #30 to #800 mesh filter is used as the filter member 64 so that the meniscus force can produce a negative pressure comparable to that of the sponge 14. The material that forms the filter member 64 provides a contact angle of greater than 5 degrees with respect to the ink so that the removal of air bubbles from the filter member 64 is facilitated.

When the meniscus force of the filter member 64 balances the pressure inside the chamber 13, the ink within the chamber 13 is retained. However, when the pressure in the chamber 13 drops as the ink is consumed, the meniscus force of the filter member 64 is canceled, causing air bubbles to intrude into the chamber 13. Immediately after air bubbles leave the filter member 64, the meniscus force is produced again by the filter member 64. Therefore, it is possible to continually retain the ink by the negative pressure until the ink surface within the chamber 13 becomes lower than the filter member 64. Since the end of the passage 63 opens upward to the chamber 12, the bubbles leave the filter member 64 before growing into large bubbles due to their buoyancy. Therefore, it is possible to restrain the variation in the pressure in the chamber 13 in response to the removal of the bubbles from the filter member 64 at a minimum level.

The bubbles entering the chamber 13 come into contact with the electrode 21*a* disposed near the top of the chamber 13 so that the amount of the ink that remains can be detected by the residual quantity detecting circuit as shown in FIG. 4. This embodiment is configured such that, when the ink is detected as having run out, the quantity of ink that actually remain in the chamber 13 is sufficient to print on at least one page. Hence, even after the ink is detected as having run out, the ink is retained by the negative pressure provided by the filter member 64 so that there is no fear of the ink running out abruptly during a printing operation.

A description will now be given of a method of calculating the quantity of the ink required to print on at least one page using one print head. For the sake of convenience of the description, the quantity of the ink required to print texts is calculated.

It is assumed that the quantity of the ink injected per the nozzle 3 is 50 pl, the resolution of the ink-jet printer is 360 dpi, the size of the recording medium is A4 (=11×8 inch), and an assumed print pattern fills 5% of the recording medium. The number of dots per a page is $$(11\times360)\times(8\times360)=11{,}404{,}800 \text{ dots}$$

The quantity of the ink used per a page is therefore $$50 \text{ pl/dots}\times11{,}404{,}800\times0.05=0.028 \text{ cc}$$

Accordingly, it is desirable that the quantity of the ink retained by the meniscus force of the filter member 64 be greater than 0.05 cc, allowing an approximately 100% margin.

Figure 12:
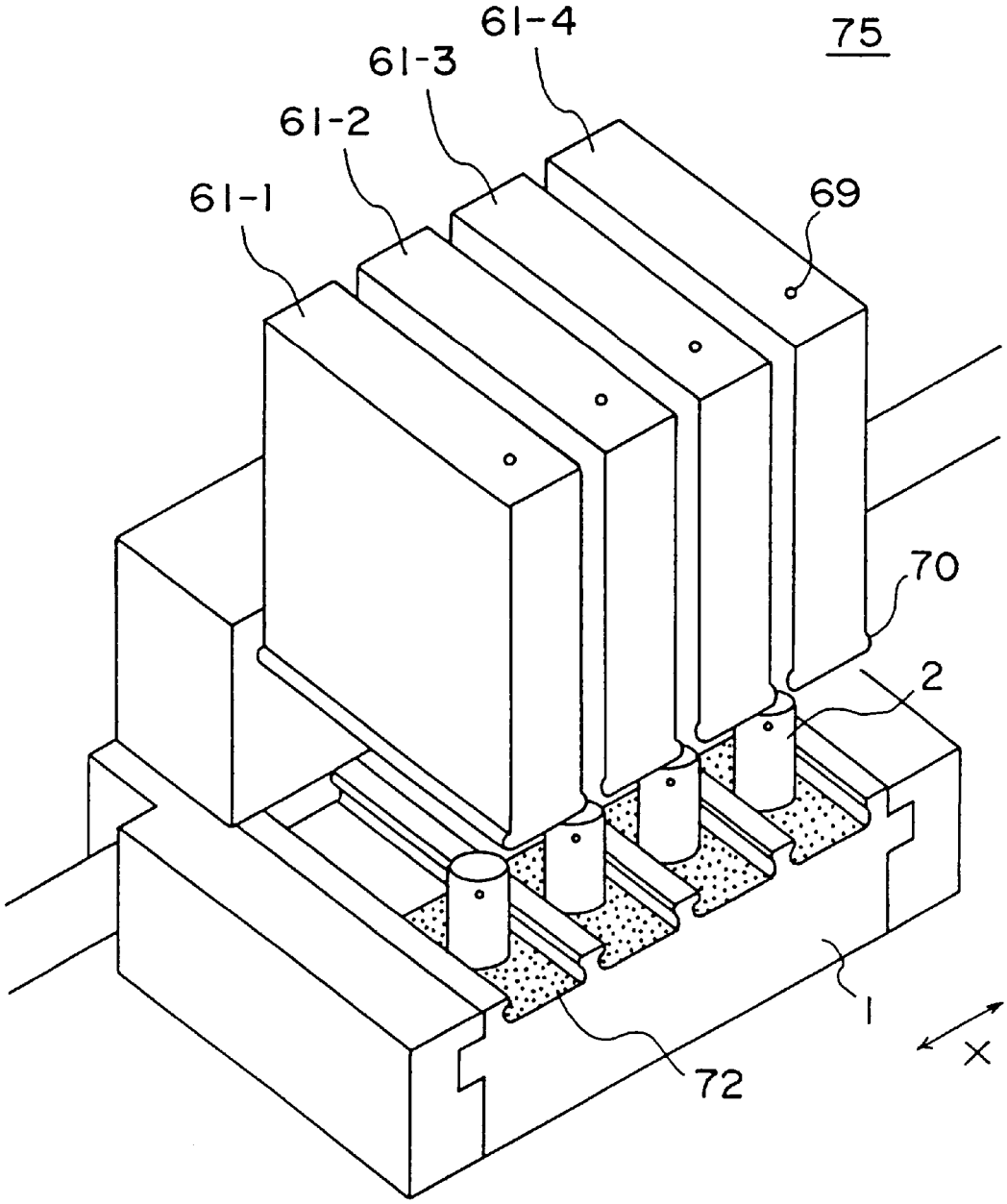
FIG. 12 is a perspective view showing a fourth embodiment of the print head and a third embodiment of the ink cartridge.

A description will now be given, with reference to FIG. 12, of a fourth embodiment of the print head according to the present invention. FIG. 12 is a perspective view showing the fourth embodiment of the print head and a third embodiment of the ink cartridge according to the present invention. In FIG. 12, those components that are the same as the components of FIG. 9 are designated by the same reference numerals, and the description thereof is omitted.

In this embodiment, four ink cartridges 61-1–61-4 are used in a print head part 75. The ink cartridges 61-1–61-4 store a black ink, a yellow ink, a magenta ink and a cyan ink, respectively. Hence, color printing is possible with this embodiment. Each of the ink cartridges 61-1–61-4 has at its top a hole 69 that opens to the atmosphere and has at its bottom a pair of projecting skirts 70. The other parts of the ink cartridges 61-1–61-4 have basically the same construction as the corresponding parts of the ink cartridge 61 described earlier.

Four print heads 1 are provided in the print head part 75. Four pairs of groove parts 72 are provided at respective portions at which the ink cartridges 61-1–61-4 are mounted. When each of the ink cartridges 61-1–61-4 is mounted to the corresponding print head 1, the pair of projecting skirts 70 are engaged with the corresponding pair of groove parts 72 so as to position the ink cartridges 61-1–61-4 in their positions. The ink cartridge is inserted from above such that the supply pipe 2 is introduced into the connection part 16 (not shown), one of the pair of projecting skirts 70 is engaged with the corresponding one of the pair of groove parts 72, the ink cartridge is then shifted slightly in the X direction in which the print head part 75 is translated so that the other of the pair of projecting skirts 70 is engaged with the other of the pair of groove parts 72.

In a second embodiment of the ink-jet printer according to the present invention, the print head part 75 shown in FIG. 12, instead of the print head part 45, is used in the construction shown in FIG. 7.

It is of course possible to employ any combination of the above-described embodiments. The number of electrodes for detecting the ink residual quantity is not limited to two. More than two electrodes may be provided. The number of chambers in the ink cartridge is not limited to two as in the above-described embodiments. More than two chambers may be provided.

The present invention is not limited to the above described embodiments, and variations and modifications may be made without departing from the scope of the present invention.

What is claimed is:

1. An ink cartridge for connecting to a print head having a supply pipe for receiving a supply of ink from said cartridge, comprising:

a casing having a partition dividing the interior of said casing into a first chamber, and a second chamber disposed below said first chamber, a connecting pipe attached at a first end to said partition and having a second end extending into a lower region of said second chamber, a hole in said partition opening upwardly into said first chamber and downwardly into the interior of said connecting pipe, an opening adjacent the second end of said connecting pipe and opening upwardly into said second chamber to establish communication between the interior of said pipe and said second chamber, a porous body in said first chamber operative to store ink therein at a negative pressure, a filter member covering said opening at said second end of said connecting pipe, said filter member developing a meniscus force operative to compensate for decreases in an ink retaining capacity of said porous body in said first chamber and being effective to release upwardly into an upper region of said second chamber air generated in the interior of said connecting pipe from a reduction in negative pressure of said porous body whereby said meniscus force in said filter member is augmented, and a connection part communicating with said second chamber and operable for detachable connection to said supply pipe.

2. The ink cartridge as claimed in claim 1, further comprising a plurality of electrodes in said second chamber operative to detect a residual quantity of ink.

3. The ink cartridge as claimed in claim 2, wherein said plurality of electrodes are disposed at predetermined positions in said second chamber such that, when ink is detected as having run out, a quantity of the ink that actually remains in said second chamber is sufficient to print at least one page.

4. The ink cartridge as claimed in claim 1, wherein said filter member is made of a #30 to #80 mesh.

5. The ink cartridge as claimed in claim 1, wherein said filter member is made of a material providing a contact angle greater than 5 degrees with respect to the ink.

6. An ink cartridge as claimed in claim 1, wherein said connection part includes a normally closed valve means for selective connection of said print head with said second chamber when said supply pipe is inserted into said connection part.

7. An ink cartridge according to claim 6, wherein said valve means includes a packing having an opening enabling said supply pipe to enter said second chamber when said ink cartridge approaches said print head, a valve body having a convex hemispherical surface effective to cooperate with a concave hemispherical surface forming a seat in said packing, and a spring urging said valve body against said seat whereby a gap is prevented from being created between said supply pipe and said valve body when said valve body is moved by said supply pipe.

8. The ink cartridge as claimed in claim 7, wherein said valve body and said packing are made of a resilient material having a hardness of 40 degrees to 70 degrees.

* * * * *